US006299420B1

(12) United States Patent
Saputo et al.

(10) Patent No.: US 6,299,420 B1
(45) Date of Patent: Oct. 9, 2001

(54) DUAL ACTION AIR PUMP

(75) Inventors: Richard A. Saputo, Tarzana, CA (US); Hua Hsiang Lin, Kowloon (HK); Yaw-Yuan Hsu, Taipei (TW)

(73) Assignee: Intex Recreation Corp., Long Beach, CA (US)

( * ) Notice: Subject to any disclaimer, the term of this patent is extended or adjusted under 35 U.S.C. 154(b) by 0 days.

(21) Appl. No.: 09/544,821

(22) Filed: Apr. 6, 2000

(51) Int. Cl.[7] ..... F04B 1/00
(52) U.S. Cl. ..... 417/527
(58) Field of Search ..... 417/527, 526, 417/440, 467, 511, 512

(56) References Cited

U.S. PATENT DOCUMENTS

| | | | | |
|---|---|---|---|---|
| 4,212,595 | | 7/1980 | Kuintzle, Jr. et al. . | |
| 4,392,784 | | 7/1983 | Hanafi . | |
| 4,990,060 | | 2/1991 | Cheng-Chung . | |
| 5,067,882 | | 11/1991 | DeVries et al. . | |
| 5,199,857 | | 4/1993 | Sanuki . | |
| 5,209,190 | | 5/1993 | Paul . | |
| 5,681,154 | | 10/1997 | Yang . | |
| 5,702,239 | | 12/1997 | Yang . | |
| 5,779,457 | * | 7/1998 | Chung et al. | 417/467 |
| 6,027,319 | * | 2/2000 | Winefordner et al. | 417/440 |
| 6,120,265 | * | 9/2000 | Wu | 417/526 |

* cited by examiner

*Primary Examiner*—Teresa Walberg
*Assistant Examiner*—Vinod D. Patel
(74) *Attorney, Agent, or Firm*—Lewis, D'Amato, Brisbois & Bisgaard LLP

(57) ABSTRACT

An air pump is a dual action manually driven with a piston and two intake and two exhaust check values that respectively operate with one intake port and one exhaust port. These check valves operate in tandem with each other during each pumping stroke, either up or down. During each pumping stroke, one intake check valve and one exhaust check valve are open with their counterparts closed, to provide continuous discharge of compressed air through the exhaust port and also to provide continuous intake of air through the intake port. The air pump includes a cylindrically shaped hollow reservoir housing, a base connected to one end of the housing, an intake port and an exhaust or inflate port which are mounted on the base, an elongated piston shaft extending along the longitudinal axis of the housing, and a handle perpendicularly disposed with respect to the piston shaft to assist pumping of the piston shaft.

24 Claims, 5 Drawing Sheets

DUAL ACTION AIR PUMP

BACKGROUND OF THE INVENTION

1. Field of the Invention

The present invention relates to an air pump, and more particularly, to a dual action air pump which can inflate and deflate at the same time and inflate an inflatable object during both up and down stroke to provide continuous discharge of compressed air.

2. Discussion of the Related Art

Children enjoy playing in inflatable toy structures, such as inflatable houses and above-the-ground pools. Conventional inflatable toy structures are inflated by using a manual or foot operated air pumps. The user of a manual air pump, such as a bicycle tire pump or inflatable toy pump, generally encounters difficulties in inflating a pneumatic article, such as a toy structure or tire. When commencing the pumping process, the article has a low (ambient) or no pressure and it is desirable to pump as large a volume of air as possible into the article with each pumping stroke. The user's difficulty at this stage is that many pumping strokes are required unless the volume of air per stroke is large. Conventional single action air pumps discharge the air inside through the air outlet only during the down stroke of the piston shaft. During the upstroke of the piston shaft, outside air is sucked into the air pump through an air inlet but no air is discharged through the air outlet.

Most manual or foot operated air pumps use the check valve concept to control the flow of air into their reservoirs and the subsequent discharging or exhausting of the air from the reservoir into the object being inflated. Check valves are necessarily provided in the air inlet and air outlet in order to control the air flow in a single direction. As an example, foot operated bellows pumps are normally spring loaded and operate with one intake and one exhaust check value. During the compression of the bellows air chamber (or reservoir) air exhausts into the object being inflated and during the spring-back, or up cycle, air refills the reservoir.

Additionally, it is a common manual air pump industry design to have this type of air pump inflate, but not deflate, an object on both the up and down strokes of the pumping cycle. These types of air pumps are commonly referred to as a double or dual action air pumps, and normally have their reservoir cylindrically shaped with intake check valves located at the opposite ends of the cylinder. As the pumping stroke drives the air out of either end of the cylinder, the opposite side check valve opens to allow the opposite side air to be replenished. During the pumping action where air on either side of a piston head is being compressed, the compressed air inflates the intended object by flowing through a side slit in a hollow piston shaft to which a hose is attached that is connected to the object to be inflated.

SUMMARY OF THE INVENTION

Accordingly, the present invention is directed to a dual action air pump that substantially obviates one or more of the problems due to limitations and disadvantages of the related art.

An object of the present invention is to provide an air pump that is used to inflate and deflate an inflatable object by changing a hose to appropriate air port opening.

Another object of the present invention is to provide an air pump that provides a continuous flow of air to an inflatable object during both up and down stroke of the piston shaft.

Another object of the present invention is to provide an air pump that provides a continuous flow of air from an inflatable object during both up and down stroke of the piston shaft.

Another object of the present invention is to provide an air pump that has both intake port and exhaust port that provide a continuous flow of air to and from the inflatable object during both up and down stroke of the piston.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an air pump comprises a first structure having a hollow interior and a piston slidably disposed in the housing to divide the hollow interior of the housing to first and second reservoirs. In the preferred embodiment, as the piston moves toward a first direction, such as upstroke, the first reservoir is compressed and as the piston moves toward a second direction, such as down stroke, the second reservoir is compressed. The air pump further comprises a second structure having gaseous communication with the first structure. The second structure has intake and exhaust chambers which are not in gaseous communication with each other. The intake chamber is in gaseous communication with an intake port. The exhaust chamber is in gaseous communication with an exhaust port. The air pump also includes first and second intake check valves and first and second exhaust check valves disposed in the air pump. The first intake check valve provides gaseous communication between the second reservoir and the intake chamber when the piston moves in the first direction. The second intake check valve provides gaseous communication between the first reservoir and the intake chamber when the piston moves in the second direction. Similarly, the first exhaust check valve provides gaseous communication between the second reservoir and the exhaust chamber when the piston moves in the second direction, and the second exhaust check valve provides gaseous communication between the first reservoir and the exhaust chamber when the piston moves in the first direction.

According to one aspect of the present invention, the first and second intake check valves are located in the second structure and are dedicated to the intake chamber. The first and second exhaust check valves are also located in the second structure and are dedicated to the exhaust chamber.

In the preferred embodiment, the first structure is a cylindrical housing fixedly attached to the second structure, which is a base, wherein the first and second intake check valves are disposed in the second reservoir of the housing. The first and second intake check valves and the first and second exhaust check valves are preferably co-planarly located on the second structure.

According to another aspect of the present invention, the air pump includes an intake transfer tube connected between the intake chamber and the first chamber with air flow being regulated by the second intake check valve. There is also an exhaust transfer tube connected between the exhaust chamber and the first chamber with air flow being regulated by the second exhaust check valve.

According to another aspect of the invention, a piston shaft is fixedly connected to the piston for biasing the piston between the first and second positions. The piston shaft is parallelly disposed with the intake and the exhaust transfer tubes.

According to another aspect of the present invention, a disk is fixedly attached to one end of the housing. The disk defines an intake conduit connected to the intake transfer tube and further defines an exhaust conduit connected to the exhaust transfer tube. The disk further defines at least one air passage which is in gaseous communication with the first reservoir of the first structure.

It is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

With reference to the drawings, and in particular to FIGS. 1–8 thereof, a dual action air pump 100 embodying the principles and concepts of the present invention will be described.

Figure 1:
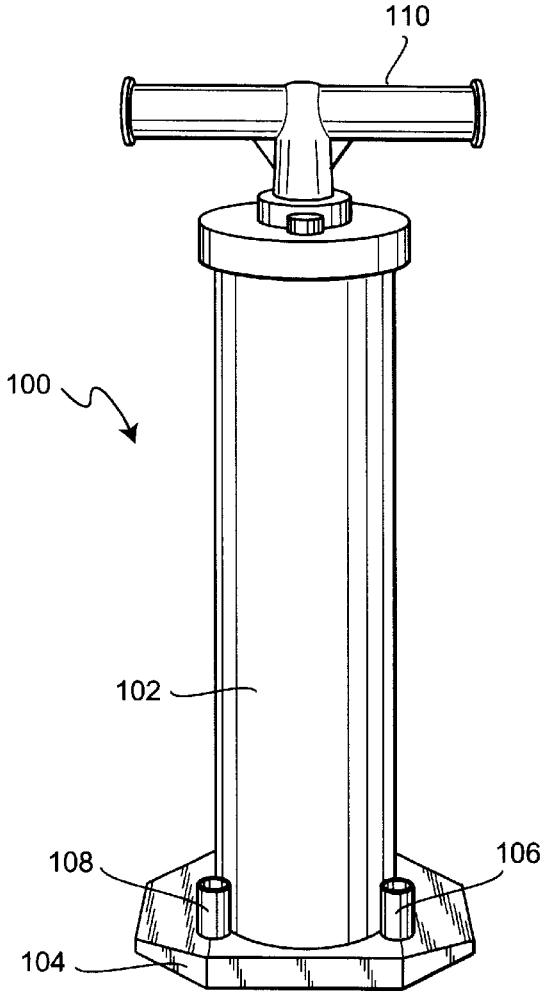
FIG. 1 illustrates a perspective view of a preferred embodiment of the dual action air pump with a piston shaft in a retracted position.
Figure 2:
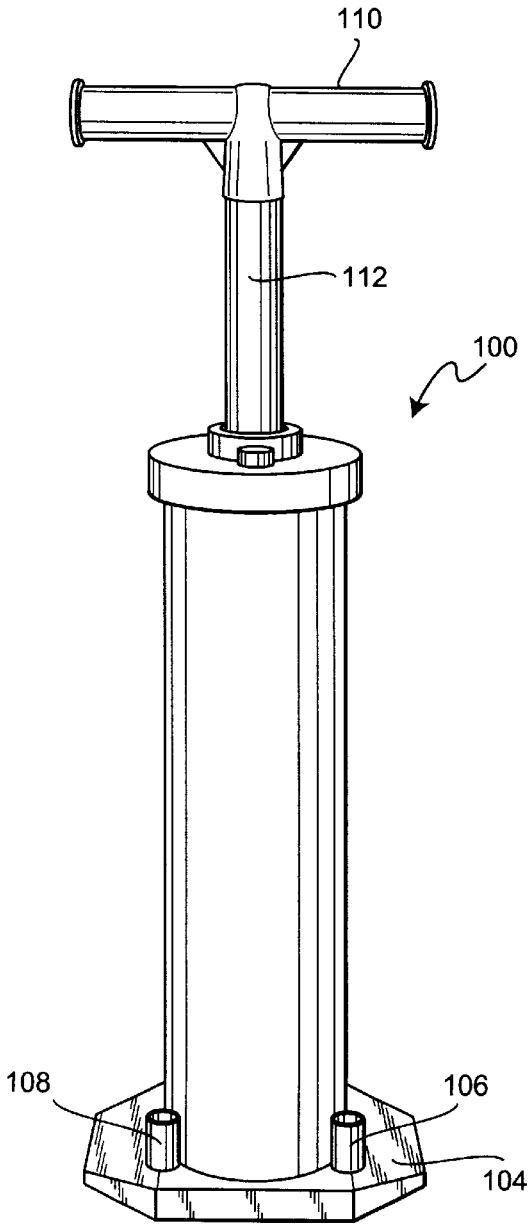
FIG. 2 illustrates a perspective view of the preferred embodiment of the dual action air pump with the shaft piston in an extended position.

FIG. 1 illustrates a perspective view of a preferred embodiment of the dual action air pump 100 with a piston shaft 112 in a retracted position. FIG. 2 illustrates a perspective view of the preferred embodiment of the air pump 100 with the piston shaft 112 in an extended position. Referring to FIGS. 1 and 2, the air pump 100 according to the present invention includes a cylindrically shaped hollow reservoir housing 102, a base 104 connected to one end of the housing 102, an intake port 106 and an exhaust or inflate port 108 which are located on the base 104, an elongated piston shaft 112 extending along the longitudinal axis of the housing 102, and a handle perpendicularly disposed with respect to the piston shaft 112 to assist pumping of the piston shaft 112. The preferred embodiment of the present invention is directed to a dual action manually driven air pump 100 with a piston and two intake and two exhaust check values that respectively operate with one intake port 106 and one exhaust (or inflation) port 108. These check valves, which are described below in detail, operate in tandem with each other during each pumping stroke, either up or down. In particular, during each pumping stroke, one intake check valve and one exhaust check valve are open with their counterparts closed, to provide continuous discharge of compressed air through the exhaust port 108 and also to provide continuous intake of air through the intake port 106.

Figure 3:
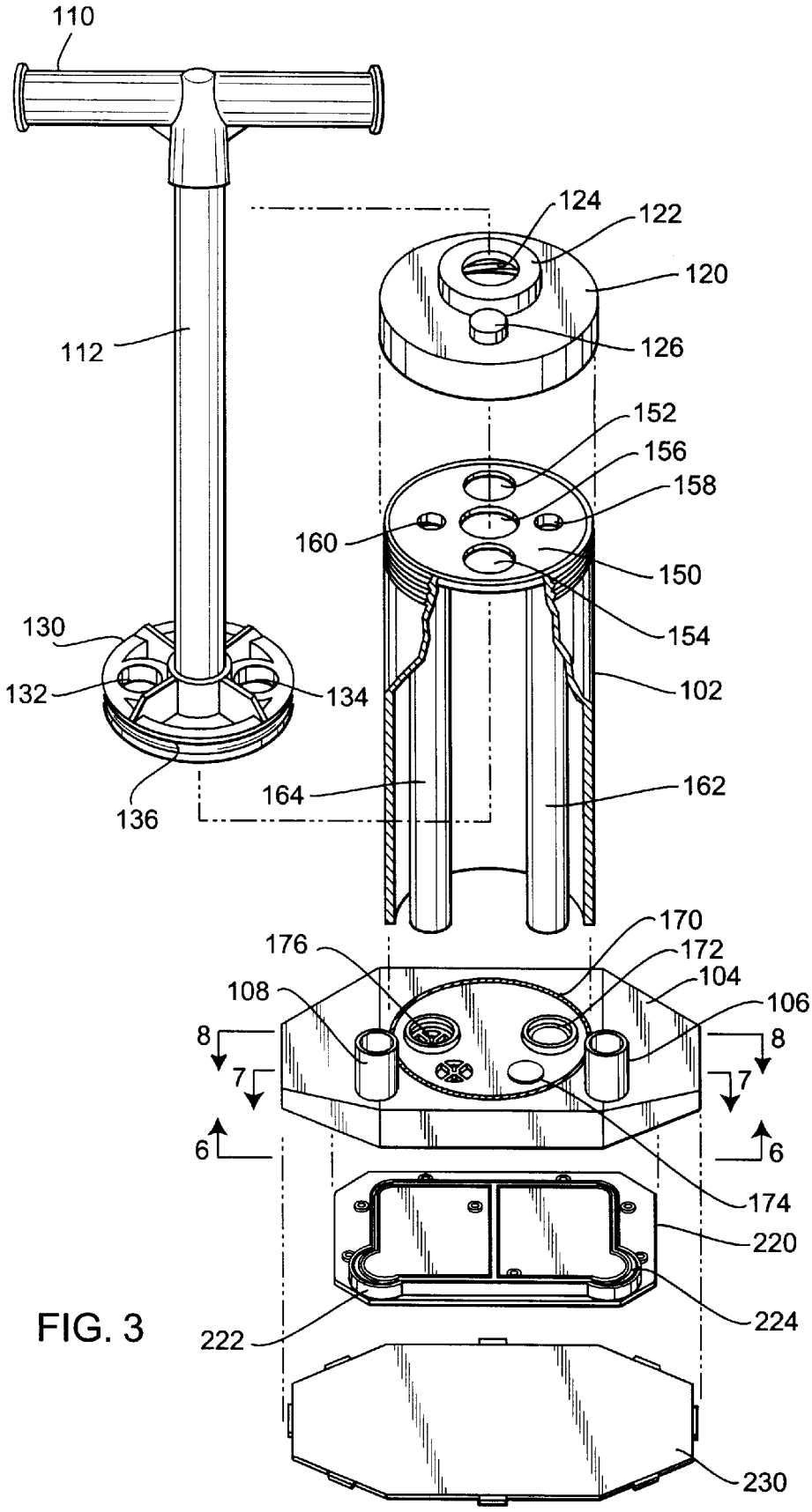
FIG. 3 illustrates an exploded view of the dual action air pump.
Figure 4:
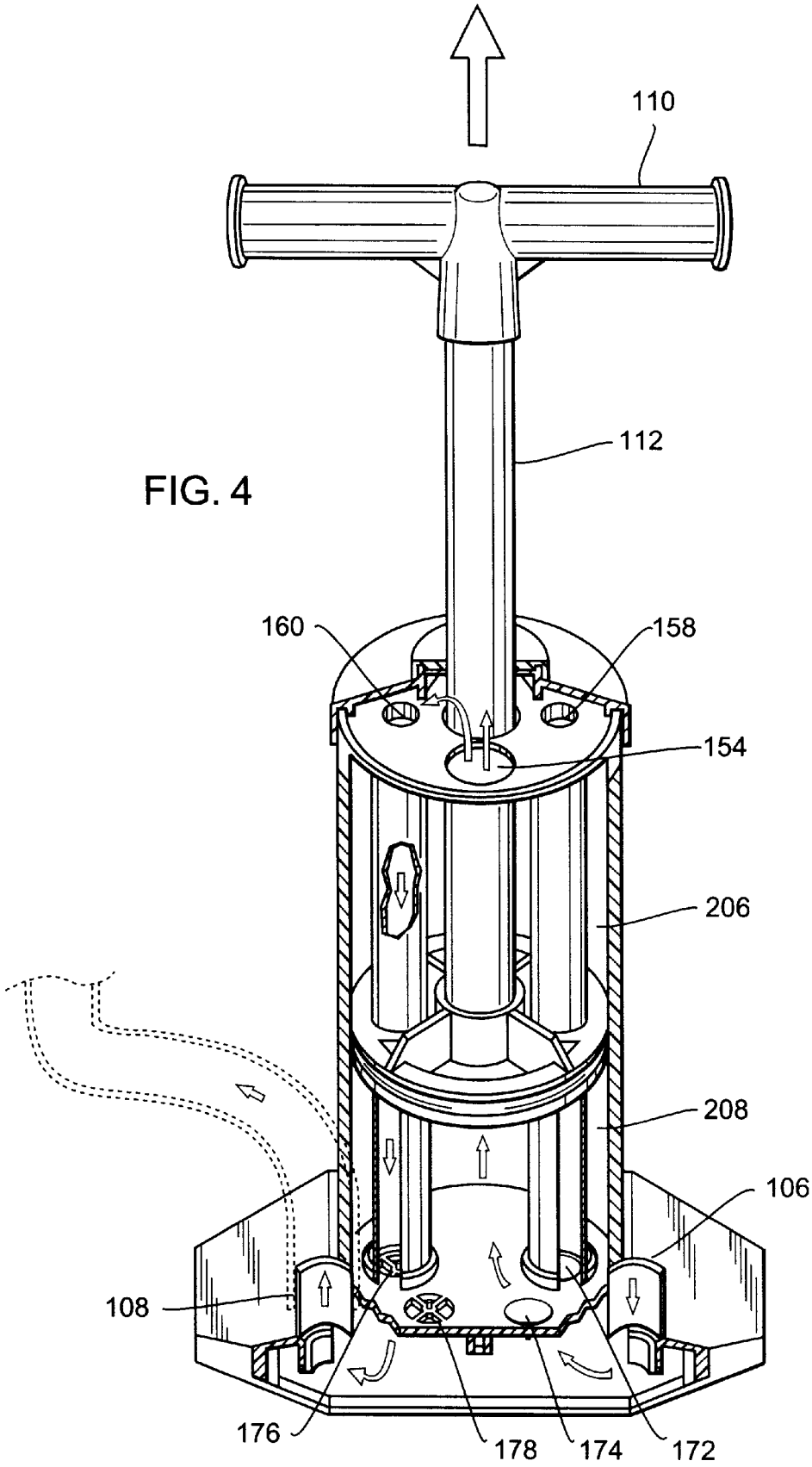
FIG. 4 illustrates a cross-sectional view of the dual action air pump showing internal components and air flow directions when the piston is moving in a up stroke.

FIG. 3 illustrates an exploded view of the air pump 100 according to the preferred embodiment of the present invention. As described above, the housing 102 is cylindrically shaped and is divided into upper and lower reservoirs 206 and 208, as shown in FIG. 4, by the placement of a piston 130 for concurrently receiving and compressing air. The length and the diameter of the housing 102, which determines the volume of the reservoirs, may be varied depend on the application of the air pump 100. The housing 102 is preferably made of rigid plastic, PVC, aluminum or other suitable materials known to one of ordinary skill in the art.

Referring to FIG. 3, the top opening end of the housing 102 is enclosed with a disk 150 having a plurality of air transport holes. The bottom opening end of the housing 102 is air tightly mounted to the base 104. Preferably, the top surface of the base 104 has a circular groove 170 for receiving therein the housing 102 in an upright position. The housing 102 and the base 104 may be securely attached to each other using adhesives or other suitable material known to one of ordinary skill in the art.

In the preferred embodiment, the disk 150 is air tightly affixed to the top end of the housing, preferably using adhesives. Alternatively, the disk 150 may have external threads which are fixedly engaged with the matching inner threads of the housing 102. The disk 150 preferably has a center hole 156 for slidably receiving therein the piston shaft 112. The diameter of the center hole 156 is about the same as that of the piston shaft 112 to snuggly fit around the circumference of the piston shaft 112. Aligned with and disposed at opposite ends of the center hole 156 are a plurality of air passages 152 and 154 which are in gaseous communication with the upper reservoir of the housing 102. In the preferred embodiment, there are two air passages 152 and 154 defined by the disk 150. Alternative, there may be one or more than two air passages. In addition to the air passages 152 and 154, there are intake and exhaust conduits 158 and 160 which are in gaseous communication with transfer tubes 162 and 164. In particular, the intake and exhaust conduits 158 and 160 are linearly aligned with the center hole 156 and are orthogonally positioned with respect to the air passages 152 and 154.

Referring further to FIG. 3, the top end of the housing 102 has outer threads for receiving thereon a cover 120 which has matching inner threads. Once placed on the housing 102, the cover 120 forms an air tight seal. The cover 120 has a piston shaft hole 124 which shares the same center axis as the cover 120. The piston shaft hole 124 is surrounded by a rim 122 having an O-ring therein to provide substantially an air tight seal with the piston shaft 112. The cover 120 also includes an input port 126 having a check valve biased to open only during a down stroke of the piston shaft 112 to fill the upper reservoir 206.

Referring to FIG. 3, parallelly extending from the bottom surface of the disk 150 are intake transfer tube 162 and exhaust transfer tube 164. Preferably, the intake transfer tube 162, the exhaust transfer tube 164 and the piston shaft 112 are in co-planarly position with respect to each other. The intake and exhaust transfer tubes 162 and 164 are elongated cylinders of identical shape and form having a hollow interior for transferring air between chambers located in the base 104. The intake and exhaust transfer tubes 162 and 164 extend along the length of the housing 102 and are in gaseous communication with the upper reservoir 206, but are not in gaseous communication with the lower reservoir 208 of the housing 102. The intake transfer tube 162 is fixedly connected and is dedicated to an intake transfer tube valve 172. The exhaust transfer tube 164 is fixedly connected and is dedicated to an exhaust transfer tube valve 176. As a result, the intake and exhaust transfer tubes 162 and 164 act as air conduits feeding and exhausting air to and from the upper reservoir 206.

According to FIG. 3, the air pump 100 also includes an elongated piston shaft 112 which is connected to the handle 110 at one end and is connected to a piston 130 at the opposite end. The piston shaft 112 and the handle 110 form a T-shaped structure. The piston 130 has a generally circular construction and has a center hole for mounting therein the end of the piston shaft 112. There are also two transfer tube through-holes 132 and 134 for slidably receiving therethrough the intake and the exhaust transfer tubes 164 and 162, respectively. The through holes 132 and 134 are each configured to be slightly larger in diameter than that of the transfer tubes 164 and 162 and provide air tight seals around the transfer tubes 164 and 162 to separate the upper and lower reservoirs 206 and 208. The through holes 132 and 134 are aligned with the intake and the exhaust conduits 158 and 160 so that the air transfer tubes 162 and 164 run co-planar and parallel to the piston shaft 112.

Around the circumference of the piston 130, there is provided a groove rail for receiving therein an O-ring 136. The O-ring 136 in piston 130 rubs against the inner wall of the upper and the lower reservoirs 206 and 208. The O-ring 136 provides an air tight seal between the piston 130 and the inner wall of the housing 102 to compress air in the upper reservoir 206 when the piston 130 is moved upward and in the lower reservoir 208 when the piston 130 is moved downward.

Figure 6:
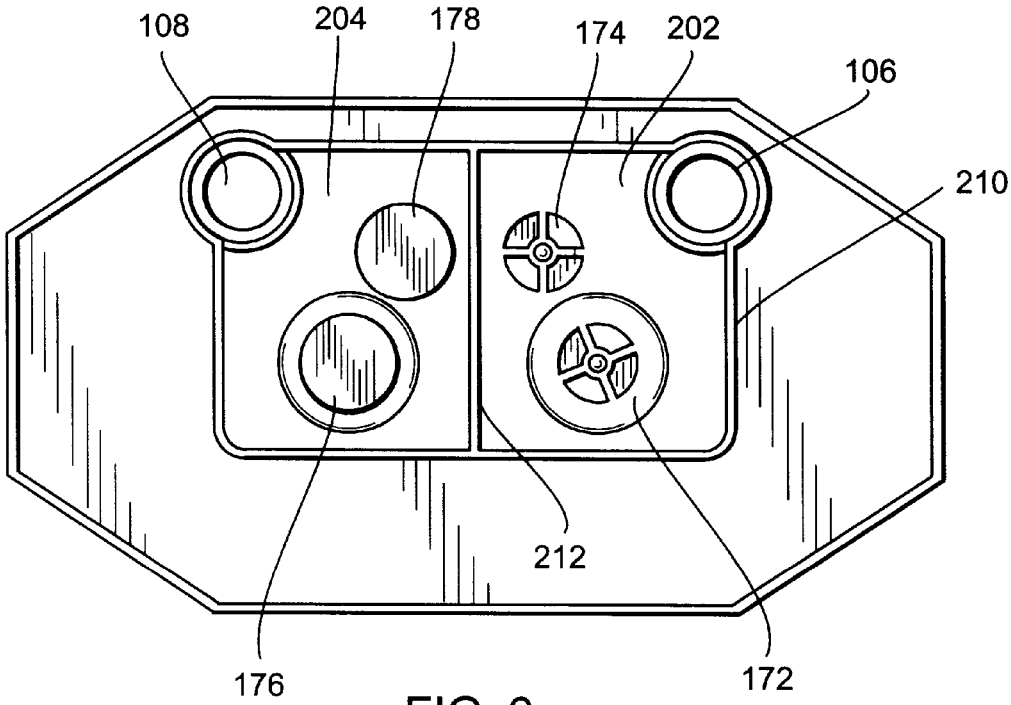
FIG. 6 illustrates a bottom planar view of the dual action air pump showing intake and exhaust check valves.

According to FIG. 3, the air pump 100 also includes the base 104 which is perpendicularly connected to the housing 102 for forming an air tight seal at the contact joint. A perspective view of the base 104 is shown in FIG. 3, and a bottom plan view of the base 104 is shown in FIG. 6. Referring to FIG. 3, the base 104 includes intake valve 174 and exhaust valve 178 which are both dedicated to the lower reservoir 208, and intake transfer tube valve 172 and exhaust transfer tube valve 176 which are both dedicated to the upper reservoir 206. All four check valves, namely intake transfer tube valve 172, intake valve 174, exhaust transfer tube valve 176 and exhaust valve 178, are located within the boundary defined by the lower opening of the housing 102. In particular, the intake and the exhaust transfer tube valves 172 and 176 are located immediately below the corresponding intake and exhaust transfer tubes 162 and 164, respectively. In other words, the intake transfer tube valve 172 is in gaseous communication with the intake transfer tube 162. Similarly, the exhaust transfer tube valve 177 is in gaseous communication with the exhaust transfer tube 164. In the preferred embodiment, all four check valves 172, 174, 176 and 178 are co-planarly located on the top of the base 104.

The construction of check valves is well known in the art. For example, each check valve used in the present invention includes a circular flexible disk, preferably made of rubber, having a center projection for engaging a valve opening. The valve is biased in one direction to permit unidirectional air flow.

Referring to FIG. 3, the base 104 also includes an intake port 106 and an exhaust port 108, which are in gaseous communication with an intake chamber 202 and an exhaust chamber 204, respectively. The intake chamber 202 includes the two intake check valves 172 and 174 and has a single intake port 106. The exhaust chamber 204 includes the two exhaust check valves 176 and 178 and has a single exhaust port 108. In the preferred embodiment, the intake transfer tube valve 172 and the intake valve 174 are positioned on one side of the base 104 to share the intake chamber 202 shown in FIG. 6. The exhaust transfer tube valve 176 and the exhaust valve 178 are positioned on the opposite side of the base 104 to share the exhaust chamber 204.

The intake port 106 is used for receiving or deflating air from outside. When connected to an inflatable article, the intake port 106 will continuously intake air to deflate such article. The exhaust port 108 is used for inflating by force outputting the compressed air inside the housing 102. The intake port 106 is in gaseous communication with the intake chamber 202. The exhaust port 108 is in gaseous communication with the exhaust chamber 204.

Referring to FIG. 3, there is provided a chamber cover 220 having a raised wall 222 in the shape of the chamber wall 210 and the dividing wall 212. The raised wall 222 is two layered with a rubber sealing ring 224 in between. The chamber cover 220 is preferably attached to the bottom of the base 104 around the intake and the exhaust chambers 202 and 204 using fasteners such as screws, or other suitable method. When the chamber cover 220 is placed against the chambers 202 and 204, the sealing ring 224 abuts against the top of the chamber wall 210 and the dividing wall 212 so that the chamber cover 220 maintains an air tight seal of the chambers 202 and 204. Once the chamber cover 220 is placed, the bottom of the base 104 is enclosed with a similarly shaped base cover 230.

Figure 7:
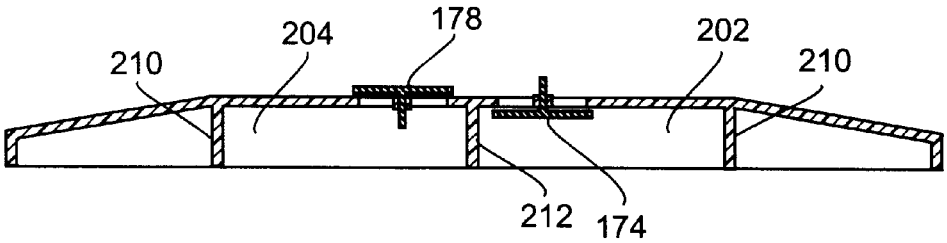
FIG. 7 illustrates a cross-sectional view of intake and exhaust check valves for a lower reservoir.
Figure 8:
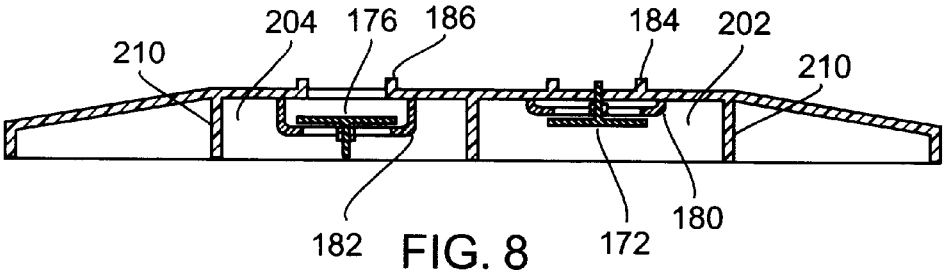
FIG. 8 illustrates a cross-sectional view of intake and exhaust check valves for an upper reservoir.

FIG. 6 illustrates a bottom planar view of the air pump 100, and particularly the base 104, showing intake and exhaust check valve arrangement. FIG. 7 illustrates a cross-sectional view of intake and exhaust valves for a lower reservoir 208. FIG. 8 illustrates a cross-sectional view of intake and exhaust valves for an upper reservoir 206. Referring to FIG. 6, the intake and the exhaust chambers 202 and 204 are defined by a generally rectangular chamber wall 210. The intake and the exhaust chambers 202 and 204 are divided by a dividing wall 212 which is of substantially the same height as the wall 210.

Referring to FIGS. 6 and 7, there are shown the exhaust valve 178 which is in gaseous communication with the exhaust chamber 204, and the intake valve 174 which is in gaseous communication with the intake chamber 202. Referring to FIGS. 6 and 8, there are shown the exhaust transfer tube valve 176 which is in gaseous communication with the exhaust chamber 204, and the intake transfer tube valve 172 which is in gaseous communication with the intake chamber 202. According to the preferred embodiment of the present invention, the intake transfer tube valve 172 is installed on an intake platform 180 and the exhaust transfer tube valve 182 is installed on an exhaust platform 182. On the top surface of the base 104 surrounding the intake and the exhaust transfer tube valves 172 and 176, there are circular rims 184 and 186 for receiving therein the intake and the exhaust transfer tubes 162 and 164, respectively. The circular rims 184 and 186 have a diameter which is slightly larger than that of the tubes 162, 164 and are respectively attached to each other using adhesives to provide an air tight seal from the lower reservoir 208.

Figure 5:
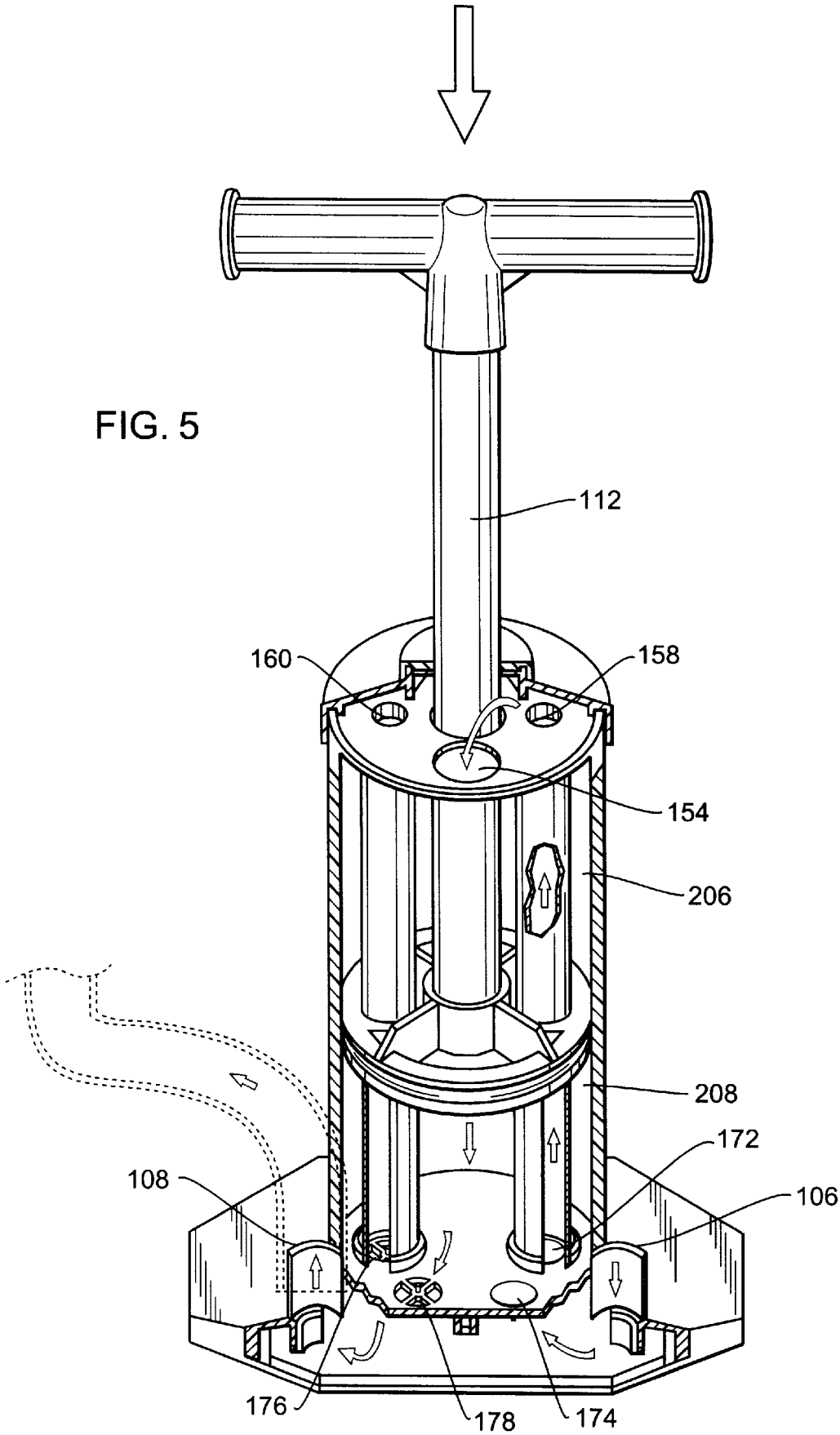
FIG. 5 illustrates a cross-sectional view of the dual action air pump showing internal components and air flow directions when the piston is moving in a down stroke.

The operation of the air pump 100 according to the preferred embodiment of the present invention will now be described in reference to FIGS. 4 and 5. FIG. 4 illustrates a cross-sectional view of the air pump 100 showing internal components and air flow directions when the piston is moving upward. As the piston 130 travels up and down, the upper and the lower reservoirs 206 and 208 compress or expand as shown in FIGS. 4 and 5, respectively. The intake port 106 and the exhaust port 108 are always unrestricted and open and feed or exhaust the intake chamber 202 and the exhaust chamber 204.

In an upstroke, the air in the upper reservoir 206 is compressed and is exhausted through the exhaust port 108 as the lower reservoir 208 is filled up with air received from the intake port 106. In particular, the intake valve 174 opens and feeds lower reservoir 208 of the housing 102. Concurrently, the exhaust valve 178 is kept closed from back pressure in the exhaust chamber 204, while the lower reservoir 208 is filled with air received from the intake port 106 of the intake chamber 202 through the intake valve 174. The compressed air in the upper reservoir 206 exits through the air passage 154, enters the exhaust conduit 160, moves down the exhaust transfer tube 164 into the exhaust chamber 204, and exits through the exhaust port 108. The following is the status of various valves used in the air pump 100 during the upstroke.

| UPSTROKE SUMMARY | |
|---|---|
| Intake valve 174 | Opens to feed lower reservoir 208 |
| Intake transfer tube valve 172 | Closes |
| Exhaust valve 178 | Closes |
| Exhaust transfer tube valve 176 | Opens to feed exhaust chamber 204 |

FIG. 5 illustrates a cross-sectional view of the air pump 100 showing internal components and air flow directions when the piston 130 is in a down stroke. In a down stroke, the lower reservoir 208 is compressed and the air therein exhausts through the exhaust port 108 while the upper reservoir 206 is filled up with air received from the intake port 106. During a down stroke, the intake valve 174 closes and the exhaust valve 178 opens allowing the compressed air in the lower reservoir 208 to escape or exhaust into the exhaust chamber 204. The compressed air then exits through the exhaust port 108. The intake transfer tube valve 172 for the upper reservoir 206 opens with air travelling through the intake port 106 into the intake chamber 202, through the intake transfer tube valve 172, and up the intake transfer tube 162. The air then exits through the intake conduit 158 and travels into the upper reservoir 206 through the air passage 154. During a down stroke, the exhaust transfer tube valve 176 is kept closed from the back pressure in the exhaust chamber 204. The following is the status of various valves used in the air pump 100 during the down stroke.

| DOWN STROKE SUMMARY | |
|---|---|
| Intake valve 174 | Closes |
| Intake transfer tube valve 172 | Opens to feed upper reservoir 206 |
| Exhaust valve 178 | Opens to feed exhaust chamber 204 |
| Exhaust transfer tube valve 176 | Closes |

As described above, on the reversing of the stroke, the check valves that were previously open now become closed and those that were closed now become open. This results in a continuous flow of air, to or from the inflatable object, depending upon whether the air hose is connected to the intake or to the exhaust port.

Although the air pump 100 described above is directed to a manually operated pump, the gist of the present invention may also be applied to an electric-type pump using the same check valve configuration.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An air pump comprising:

a first structure having a hollow interior;

a piston slidably disposed in the housing to divide the hollow interior of the housing to first and second reservoirs, wherein as the piston moves toward a first direction, the first reservoir is compressed and as the piston moves toward a second direction, the second reservoir is compressed;

a second structure having gaseous communication with the first structure, the second structure having intake and exhaust chambers which are not in gaseous communication with each other, the intake chamber being in gaseous communication with an intake port, the exhaust chamber being in gaseous communication with an exhaust port; and first and second intake check valves disposed in the air pump, wherein the first intake check valve provides gaseous communication between the second reservoir and the intake chamber when the piston moves in the first direction, and the second intake check valve provides gaseous communication between the first reservoir and the intake chamber when the piston moves in the second direction.

2. The air pump of claim 1, further comprising:

first and second exhaust check valves disposed in the air pump, wherein the first exhaust check valve provides gaseous communication between the second reservoir and the exhaust chamber when the piston moves in the second direction, and the second exhaust check valve provides gaseous communication between the first reservoir and the exhaust chamber when the piston moves in the first direction.

3. The air pump of claim 2, wherein the first and second exhaust check valves are located in the second structure and are dedicated to the exhaust chamber.

4. The air pump of claim 2, wherein the first structure is a cylindrical housing fixedly attached to the second structure, wherein the first and second exhaust check valves are disposed in the second reservoir of the housing.

5. The air pump of claim 2, further comprising an exhaust transfer tube connected between the exhaust chamber and the first chamber with air flow being regulated by the second exhaust check valve.

6. The air pump of claim 2, further comprising a piston shaft fixedly connected to the piston for positioning the piston between the first and second positions.

7. The air pump of claim 2, wherein the first and second intake check valves and the first and second exhaust check valves are co-planarly located on the second structure.

8. The air pump of claim 1, wherein the first and second intake check valves are located in the second structure and are dedicated to the intake chamber.

9. The air pump of claim 1, wherein the first structure is a cylindrical housing fixedly attached to the second structure, wherein the first and second intake check valves are disposed in the second reservoir of the housing.

10. The air pump of claim 1, further comprising an intake transfer tube connected between the intake chamber and the first chamber with air flow being regulated by the second intake check valve.

11. The air pump of claim 10, further comprising an exhaust transfer tube connected between the exhaust chamber and the first chamber with air flow being regulated by the second exhaust check valve.

12. The air pump of claim 11, further comprising a piston shaft fixedly connected to the piston for positioning the piston between the first and second positions, wherein the piston shaft is parallelly disposed with the intake and the exhaust transfer tubes.

13. The air pump of claim 11, firer comprising a disk fixedly attached to one end of the housing, wherein the disk defines an intake conduit connected to the intake transfer tube and further defines an exhaust conduit connected to the exhaust transfer tube.

14. The air pump of claim 13, wherein the disk further defines at least one air passage which is in gaseous communication with the first reservoir of the first structure.

15. The air pump of claim 1, further comprising a piston shaft fixedly connected to the piston for positioning the piston between the first and second positions.

16. An air pump comprising:

a housing having a hollow interior and first and second ends, the second end of the housing being closed with a cover defining a through hole;

a piston shaft slidably disposed through the through hole of the cover, the piston shaft having an end with a piston slidably disposed in the housing to divide the hollow interior of the housing to first and second reservoirs, wherein as the piston moves toward a first direction, the first reservoir is compressed and as the piston moves toward a second direction, the second reservoir is compressed;

a seal disposed around the piston, the seal having an outer periphery contacting an inner periphery of the housing;

a base having gaseous communication with the housing and fixedly connected to the first end of the housing, the base having intake and exhaust chambers which are not in gaseous communication with each other, the intake chamber being in gaseous communication with an intake port, the exhaust chamber being in gaseous communication with an exhaust port;

first and second intake check valves disposed in the air pump, wherein the first intake check valve provides gaseous communication between the second reservoir and the intake chamber when the piston moves in the first direction, and the second intake check valve provides gaseous communication between the first reservoir and the intake chamber when the piston moves in the second direction;

first and second exhaust check valves disposed in the air pump, wherein the first exhaust check valve provides gaseous communication between the second reservoir and the exhaust chamber when the piston moves in the second direction, and the second exhaust check valve provides gaseous communication between the first reservoir and the exhaust chamber when the piston moves in the first direction;

an intake transfer tube connected between the intake chamber and the first chamber with air flow being regulated by the second intake check valve; and an exhaust transfer tube connected between the exhaust chamber and the first chamber with air flow being regulated by the second exhaust check valve.

17. The air pump of claim 16, wherein the first and second intake check valves are located in the second structure and are dedicated to the intake chamber.

18. The air pump of claim 17, wherein the first and second exhaust check valves are located in the second structure and are dedicated to the exhaust chamber.

19. The air pump of claim 18, wherein the housing is fixedly attached to the second structure, wherein the first and second exhaust check valves are disposed in the second reservoir of the housing.

20. The air pump of claim 16, wherein the housing is fixedly attached to the second structure, wherein the first and second intake check valves are disposed in the second reservoir of the housing.

21. The air pump of claim 16, wherein the first and second intake check valves and the first and second exhaust check valves are co-planarly located on the base.

22. The air pump of claim 16, further comprising a disk fixedly attached to the second end of the housing, wherein the disk defines an intake conduit connected to the intake transfer tube and defines an exhaust conduit connected to the exhaust transfer tube.

23. The air pump of claim 22, wherein the disk further defines at least one air passage which is in gaseous communication with the first reservoir of the housing.

24. An air pump comprising:

a cylindrical housing having a hollow interior;

a piston slidably disposed in the housing to divide the hollow interior of the housing to first and second reservoirs, wherein as the piston moves toward a first direction, the first reservoir is compressed and as the piston moves toward a second direction, the second reservoir is compressed;

a second structure having gaseous communication with the first structure, the second structure having intake and exhaust chambers which are not in gaseous communication with each other, the intake chamber being in gaseous communication with an intake port, the exhaust chamber being in gaseous communication with an exhaust port;

first and second intake valve means, wherein the first intake check valve means is provided for controlling air flow between the second reservoir and the intake chamber when the piston moves in the first direction, and the second intake check valve means is provided for controlling air flow between the first reservoir and the intake chamber when the piston moves in the second direction; and first and second exhaust check valve means, wherein the first exhaust check valve means is provided for controlling air flow between the second reservoir and the exhaust chamber when the piston moves in the second direction, and the second exhaust check valve means is provided for controlling air flow between the first reservoir and the exhaust chamber when the piston moves in the first direction.

* * * * *